United States Patent [19]

Colby

[11] Patent Number: 4,490,879

[45] Date of Patent: Jan. 1, 1985

[54] SCRAPING TOOL

[76] Inventor: Robert E. Colby, 97 Clark St., Brockton, Mass. 02402

[21] Appl. No.: 504,520

[22] Filed: Jun. 15, 1983

[51] Int. Cl.[3] ..... F23J 3/00

[52] U.S. Cl. ..... 15/242; 15/236 R; 30/172

[58] Field of Search ..... 15/104.16, 104.17, 104.18, 15/105, 236 R, 242, 243, 249; 30/172

[56] References Cited

U.S. PATENT DOCUMENTS

| | | | |
|---|---|---|---|
| 1,564,199 | 12/1925 | Cantrell | 30/172 |
| 1,758,950 | 5/1930 | Hunecke | 15/243 |
| 2,275,320 | 3/1942 | Savicki | 15/162 |
| 4,254,528 | 3/1981 | Souliere | 15/243 X |

FOREIGN PATENT DOCUMENTS

| | | | |
|---|---|---|---|
| 1532 | of 1912 | United Kingdom | 15/104.16 |

*Primary Examiner*—Edward L. Roberts

*Attorney, Agent, or Firm*—Wolf, Greenfield & Sacks

[57] ABSTRACT

A scraping tool comprising scraping means adjustably and removably securable to an elongated, rigid handle, the scraping means comprising two rigid metal blades each having a scraping edge, and securing means for attaching one or both blades to the handle as desired, the securing means further enabling the position and distance of each blade edge relative to the handle to be selectively adjusted when both blades are attached to the handle. Preferably, the handle is provided with interconnection means for connecting additional lengths of handle so that the total length of the handle may be increased as desired.

7 Claims, 8 Drawing Figures

SCRAPING TOOL

FIELD OF THE INVENTION

This invention relates to a scraping tool and particularly to a scraping tool for removing creosote from the walls of a chimney flue.

BACKGROUND OF THE INVENTION

For reasons of safety and efficiency, chimney flues should be cleaned and scraped regularly to remove creosote deposits. Creosote is a crusty black layer that builds up in the flue as hot, unburned gases and tar-like liquids go up the flue with the smoke from a stove or fireplace fire. As these substances contact cooler surfaces they condense, leaving behind a creosote deposit that builds up fire after fire; the deposits are most heavy at the cooler areas of the chimney, particularly at the top and in the throat area. This creosote build-up acts like an insulator, reducing heat transfer efficiency. Large deposits can even block the flue. Creosote is highly flammable and is a significant cause of house fires. As a general rule, heavily used fireplaces should be cleaned yearly. If a modern, airtight stove has been installed in the fireplace, cleaning should occur more frequently.

At present, creosote is removed from a chimney flue primarily by the use of wire brushes. For cleaning the chimney flue liner, the brushes are raised and lowered within the flue by means of ropes or poles. At the throat area of the flue, wire brushes may be inserted into the flue from below. Another device employs rods of fiberglass or the like which can be connected end to end for lowering a wire brush into the flue. However, it has been found that, while these wire brushes are effective in removing some of the creosote deposit, they do not readily permit sufficient force to be applied to the chimney flue walls to enable removal of heavy creosote deposits. Therefore, it is desirable that a tool be provided that will facilitate removal of heavy creosote deposits from the flue by enabling the user to apply greater force to the chimney wall from various directions in a more sustained manner than has been possible with heretofore-available devices.

OBJECTS OF THE INVENTION

Therefore, it is an object of my invention to provide a scraping tool that will facilitate removal of creosote deposits from a chimney flue.

It is a further object of my invention to provide a scraping tool that will permit use of sufficient efficiently-directed force against the chimney walls to permit removal of heavy creosote deposits.

It is a still further object of my invention to provide a scraping tool that is readily maneuverable within the chimney flue so that the scraping force may be applied to the walls from various angles as desired.

It is another object of my invention to provide a scraping tool whose scraping edges are adjustable in position relative to the handle so as to provide maximum versatility.

It is a still another object of my invention to provide a scraping tool that may be readily assembled and disassembled in different forms so as to permit the scraping tool to be used both from above the chimney into the flue, and from the fireplace through the throat area of the flue, with maximum efficiency.

SUMMARY OF THE INVENTION

The objects set forth above are satisfied by the scraping tool of my invention, which comprises scraping means adjustably and removably securable to an elongated, rigid handle, said scraping means comprising two rigid metal blades each having a scraping edge, and securing means enabling either one or both blades to be attached to the handle and further enabling the position and distance of each blade edge relative to the handle to be selectively adjusted when both blades are attached to the handle. Preferably, the handle is provided with interconnection means for connecting additional lengths of handle material so that the length of the handle may be increased as desired.

DETAILED DESCRIPTION OF THE INVENTION

Figure 1:
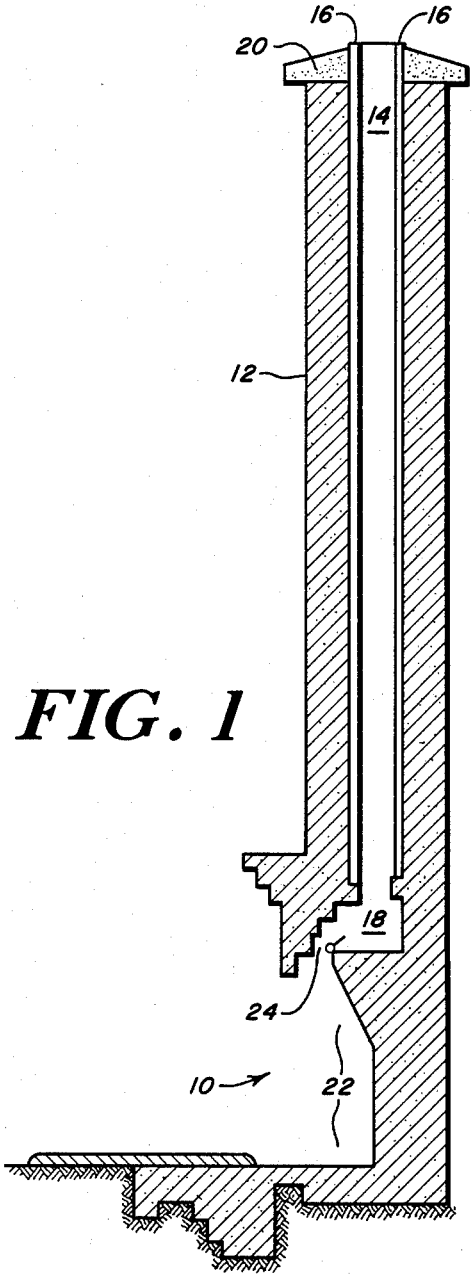
FIG. 1 is an illustrative sectional view of a typical domestic fireplace, including a firebox, flue and chimney.

There is depicted in FIG. 1 a typical fireplace 10, chimney 12 and flue 14. Flue 14 is typically lined with a ceramic flue liner 16. Chimney 12 extends approximately from smoke chamber 18 to concrete cap 20. Creosote builds up heavily on the flue liner 14, particularly in the region near the top of the chimney flue, and in the throat area 24, just above firebox 22.

Figure 2:
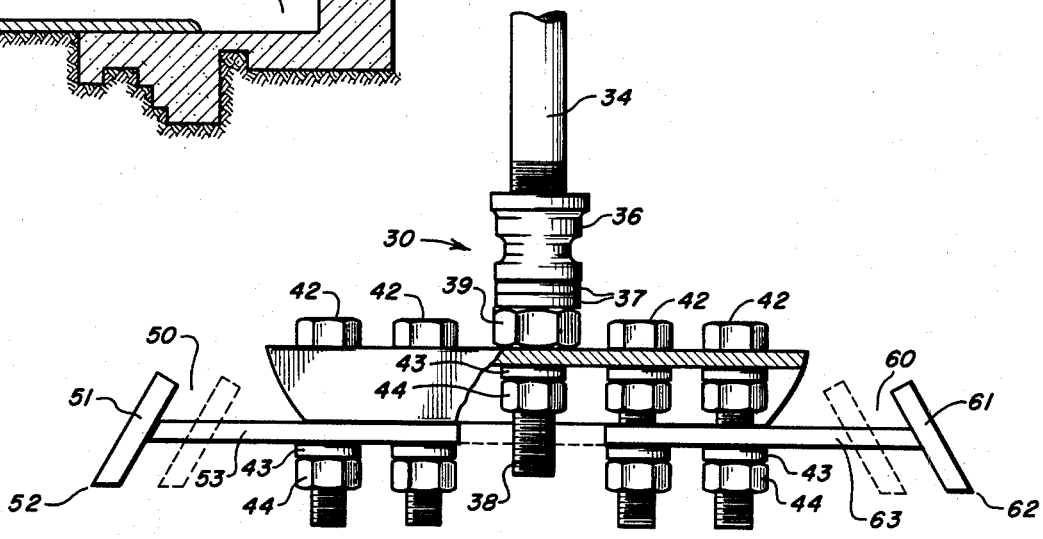
FIG. 2 is a plan view, partly in section, of a scraping tool according to the preferred embodiment of my invention.
Figure 4:
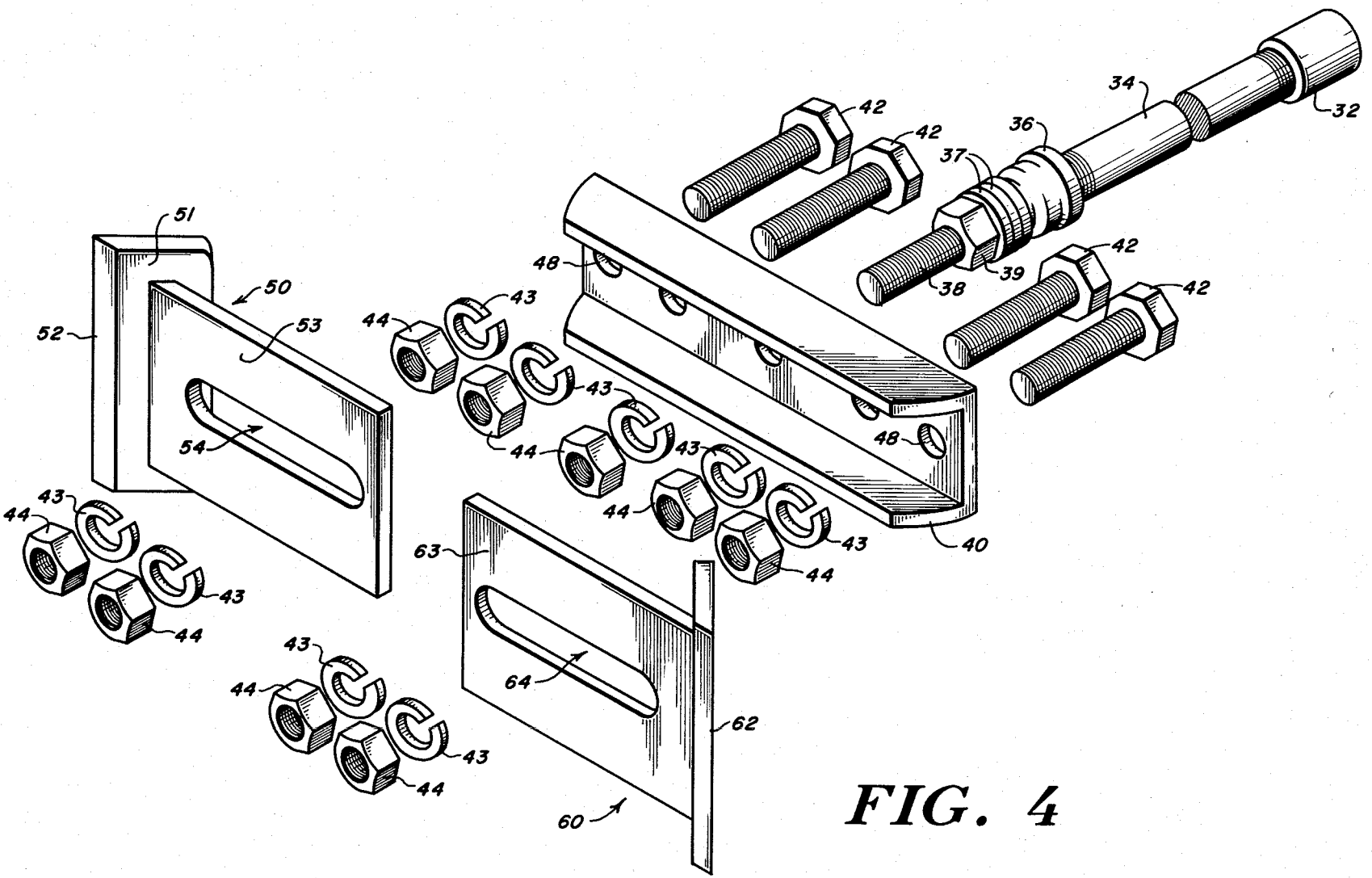
FIG. 4 is an exploded view of the scraping tool of FIG. 2.

Turning to FIGS. 2 and 4, there is depicted a scraping tool 30 according to the preferred embodiment of my invention. Two blades 50 and 60 include scraping edges 52 and 62 respectively, spaced apart from each other and located on either side of handle 34. Blades 50 and 60 are each preferably comprised of two flat pieces of one-quarter inch steel welded together in the shape of an elongated "T", but with the head 51, 61 of each "T" meeting the leg 53, 63 at an angle of approximately 60 degrees on the side of the leg farthest from the respective cutting edge. The head and the leg of each "T" are preferably welded together by a low hydrogen technique. The heads 51, 61 of blades 50, 60 are preferably of forged, hardened steel. Scraping edges 52 and 62 are formed at an angle of approximately 45° along one side of the head 51, 61 of each "T". As seen in FIG. 4, blades 50 and 60 include slots 54 and 64, respectively, formed in the leg portion 53, 63 of blades 50 and 60, which slots permit adjustment of the position of the blades as further explained below. In the particular embodiment here described, the length of the scraping edge of each blade is approximately four inches.

Blades 50 and 60 are secured to handle 34 by securing means including coupling 36, washers 37, thread rod 38, nut 39, bolts 42, lock washers 43, nuts 44 and cross-bar 40. Handle 34 preferably comprises an approximately four-foot long section of $\frac{3}{8}$-inch iron pipe threaded at both ends. At the end to which the securing means and blades are attached, coupling 36, preferably made of iron, is screwed onto handle 34. Coupling 36 is threaded at one end to receive handle 34, and at the other end to receive a length of thread rod 38 which projects out of coupling 36. Thread rod 38 is secured in place by nut 39 and washers 37, nut 39 being tightened down on coupling 36 so that thread rod 38 extends outward from and along the axis of the handle as shown in FIGS. 2 and 4.

Cross-bar 40 is preferably fabricated of one-quarter inch steel, formed in the shape of an elongated, right-angle "U". Cross-bar 40 is provided with five holes 48 in the base of the "U", the middle hole 48 receiving thread rod 38. A lock washer 43 and nut 44 are placed on thread rod 38 projecting through middle hole 48 and are tightened down to secure cross-bar 40 to handle 34. Bolts 42 are then passed through the remaining four holes 48 of cross-bar 40 and are secured in place by lock washers 43 and nuts 44. Blades 50 and 60 may then be placed on cross-bar 40 so that the leg portions 53, 63 of the blades rest on the top of the "U" of cross-bar 40, with bolts 42 projecting through slots 54 and 64. The positions of blades 50 and 60 may be adjusted by sliding blades 50 and 60 toward or away from the axis of handle 34 (see the dotted lines in FIG. 2). After the blades have been positioned in the desired location, the blades may be secured to cross-bar 40 by securing nuts 44 and lock-washers 43 to bolts 42. In the preferred embodiment here depicted, the spacing between the blade edges may be adjusted from approximately $10\frac{1}{2}$ inches to about $14\frac{5}{8}$ inches.

Figure 3:
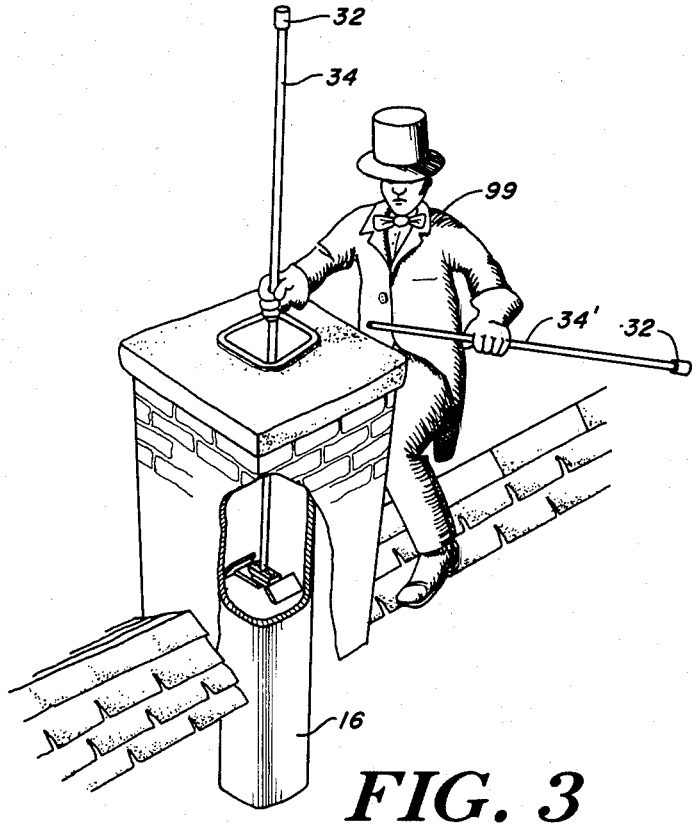
FIG. 3 is an illustrative perspective view of the use of the scraping tool of FIG. 2, wherein said tool is introduced into the chimney flue from the top of the chimney.

Turning to FIG. 3, there is illustrated the use of the scraping tool of the instant invention to remove creosote from a chimney flue, introducing the scraping tool from the top of the chimney. Blades 50 and 60 have preferably been adjusted in position so that the distance separating scraping edges 52 and 62 is approximately equal to the distance between the flue walls being scraped. The cross-sectional dimension of a typical fireplace flue is approximately $10\frac{3}{8}$ inches $\times$ $6\frac{3}{8}$ inches. The scraping tool of the instant invention is preferably adjusted first for one dimension of the flue, and then for the other. These adjustments may be made rapidly by the user simply by loosening nuts 44 that hold blades 50 and 60 in place, adjusting the position of blades 50 and 60, and then re-tightening nuts 44 on bolts 42. The scraping tool of my invention allows the user to maneuver scraping edges 52 and 62 into various angles with the flue walls, so that, by stroking up and down while moving the handle to one side or another, the maximum leverage and the most efficient scraping angle may be utilized. The scraping tool of my invention is particularly useful in connection with straight-drop chimneys that include a ceramic liner, for example of terra-cotta. It is not recommended that my scraping tool be used in irregular or offset chimneys.

In FIG. 3, chimney sweep 99 can be seen to be holding a further section of handle 34' ready to be attached at one end to handle 34 by means of connector 32 (see FIG. 4), which connector is preferably made of steel and is internally threaded at both ends. Another connector 32 at the other end of section 34' will permit connection of another section of handle, and so forth. Each section of handle is approximately four feet long, although other lengths may obviously be utilized with satisfactory results.

Figures 5, 6:
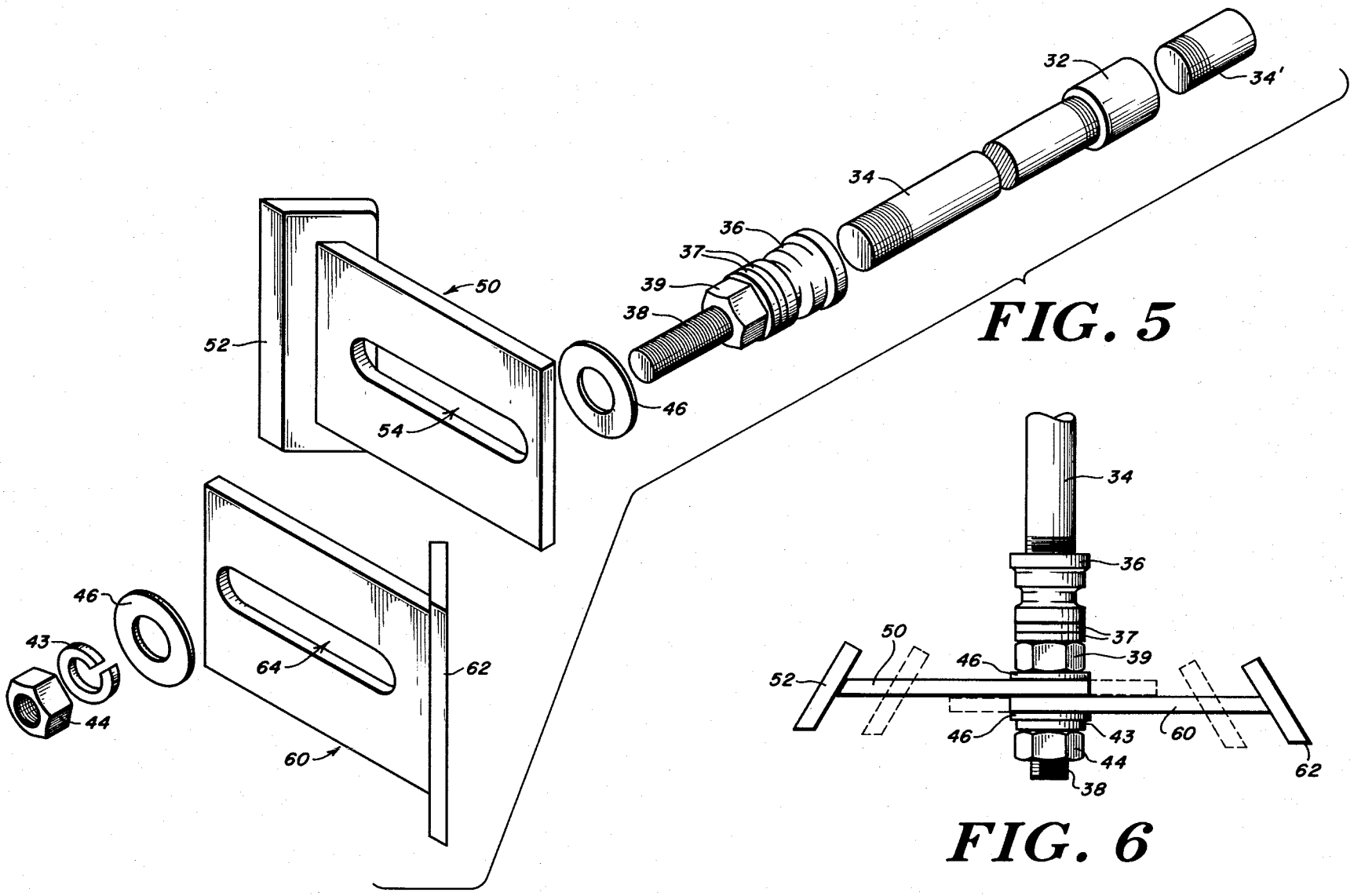
FIG. 5 is an exploded view of the scraping tool of my invention wherein the securing means have been modified to permit a further range of adjustment of the scraping edges relative to the handle.
FIG. 6 is a plan view of the scraping tool of FIG. 5.

FIG. 5 depicts an alternative arrangement of the scraping tool of my invention, wherein blades 50 and 60 are attached directly to handle 34 by means of coupling 36, washers 37, thread rod 38, nut 39, lock-washer 43, nut 44 and washers 46. Cross-bar 40 (of FIGS. 2 and 4) is not utilized. Blades 50 and 60 may be adjusted on handle 34 as shown by the dotted lines in FIG. 6. This particular arrangement is useful when the dimensions of the chimney flue are such that the arrangement of FIG. 2 cannot be accommodated. By this arrangement, in the particular embodiment here shown, the distance between the scraping edges may be adjusted from about 6 inches to $8\frac{5}{8}$ inches.

Figure 8:
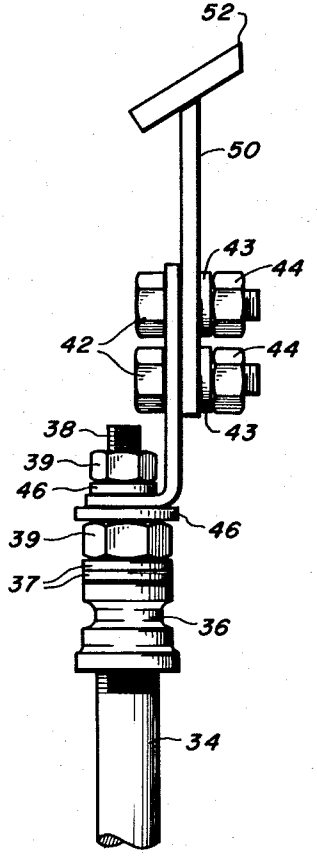
FIG. 8 is a plan view of the scraping tool of FIG. 7.
Figure 7:
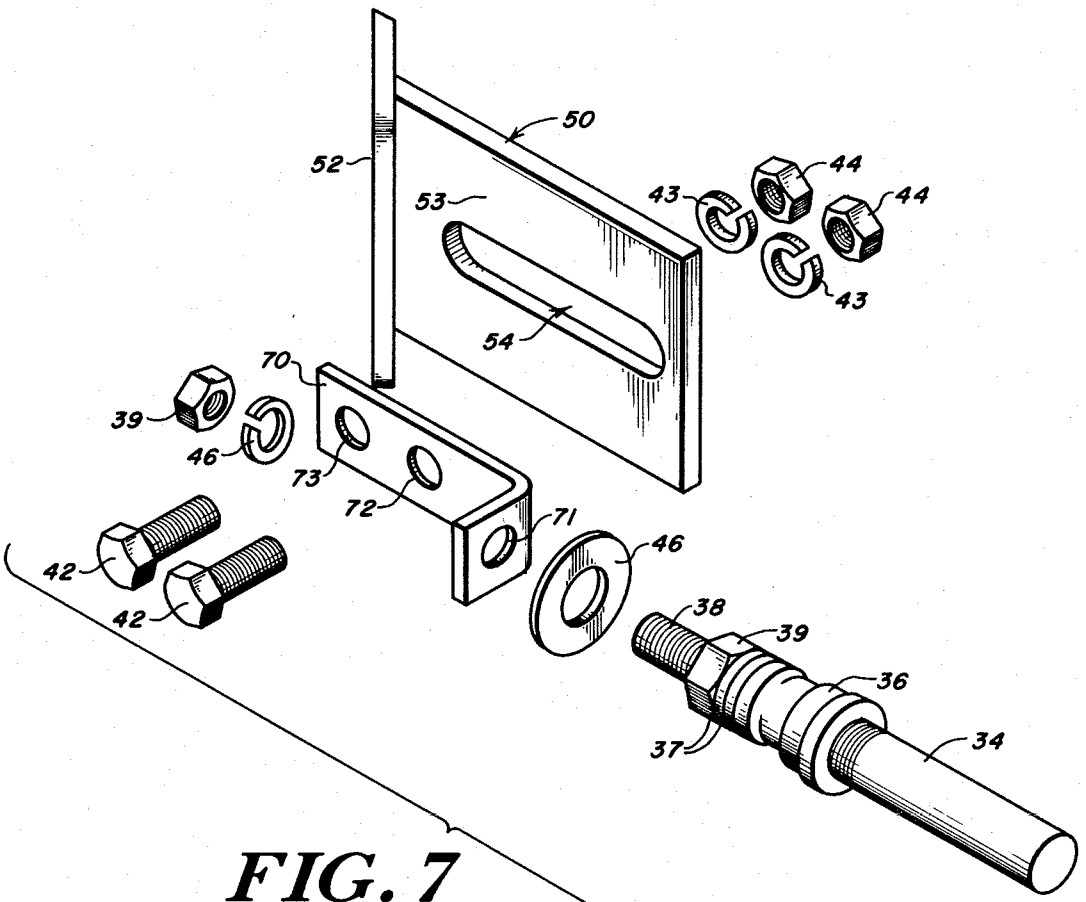
FIG. 7 is an exploded view of the scraping tool of my invention, wherein a single blade is attached to the handle.

In FIGS. 7 and 8 there is shown another arrangement of the scraping tool of this invention, wherein only one blade 50 is secured to handle 34 by means of L-shaped bracket 70. Bracket 70 is preferably fabricated of 3/16 inch steel, and includes three holes 71, 72, 73 as shown. Washer 46 is placed over thread rod 38 extending from coupling 36, and thread rod 38 is then placed through hole 71, nut 39 and washer 46 then securing bracket 70 to thread rod 38. Bolts 42 are then placed through holes 72 and 73, and slot 54 of blade 50 is placed over the bolts 42 so that the leg 53 of blade 50 rests on bracket 70. Lock-washers 43 and nuts 44 are tightened on bolts 42 to secure blade 50 to bracket 70, as shown in FIG. 8.

The one-blade arrangement of FIGS. 7 and 8 is particularly useful in removing creosote from the throat area of the flue, since it can be readily maneuvered in small spaces, and yet provides good leverage and scraping power to the user.

Thus the scraping tool of my invention provides the user with several alternative arrangements so that the maximum scraping efficiency can be achieved. The tool may be re-arranged easily and quickly, thereby facilitating the work of the user, and resulting in a faster and more thorough cleaning of the chimney flue.

It will be readily appreciated by those skilled in the art that the present invention in its broader aspects is not limited to the specific embodiments herein shown and described. Accordingly, variations may be made from the embodiments described herein which are within the scope of the accompanying claims, without departing from the principles of the invention and without sacrificing its chief advantages.

What I claim is:

1. A scraping tool for removing creosote from a chimney flue, comprising:

an elongated, rigid handle;

two rigid metal blades each having a scraping edge, each of said blades being constructed of two substantially flat plates joined together in a configuration substantially T-shaped in cross-section, the plate forming the head of the T having said scraping edge formed along one elongated side thereof, said head of each T meeting the leg of the T at an acute angle on the side of the leg farthest from the scraping edge, the plate forming the leg of the T lying in a plane perpendicular to the axis of the handle when said blades are secured to the handle, and said scraping edges lying on the sides of the heads farthest from said end of said handle; and securing means for removably securing said blades at one end of said handle, and enabling the position and distance of each scraping edge relative to the handle to be selectively adjusted.

2. The scraping tool of claim 1, wherein said acute angle is approximately 60°.

3. The scraping tool of claim 1, wherein said securing means includes an elongated rigid bar substantially U-shaped in cross-section, said bar being secured to said handle such that the base of the U is perpendicular to the axis of the handle, said legs of said blades resting along the top of the U when said blades are secured to said handle.

4. The scraping tool of claim 3, further comprising interconnection means located at the other end of said handle for attachment of additional lengths of handle material so that the total length of the handle may be increased incrementally as desired.

5. A scraping tool for removing creosote from a chimney flue, comprising:

an elongated, rigid handle;

two rigid metal blades each having a scraping edge, each of said blades being constructed of two substantially flat plates joined together in a configuration substantially T-shaped in cross-section, the plate forming the head of the T having said scraping edge formed along one elongated side thereof, said head of each T meeting the leg of the T at an acute angle on the side of the leg farthest from the scraping edge, the plate forming the leg of the T lying in a plane perpendicular to the axis of the handle when said blades are secured to the handle, and said scraping edges lying on the sides of the heads farthest from said end of said handle; and securing means for removably securing one or both of said blades at one end of said handle, and enabling the position and distance of each scraping edge relative to the handle to be selectively adjusted when both blades are attached to the handle.

6. The scraping tool of claim 5, wherein said acute angle is approximately 60°.

7. The scraping tool of claim 5, wherein said securing means includes an elongated rigid bar substantially U-shaped in cross-section, said bar being secured to said handle such that the base of the U is perpendicular to the axis of the handle, said legs of said blades resting along the top of the U when said blades are secured to said handle.

* * * * *